US009418599B2

(12) United States Patent
Yang

(10) Patent No.: US 9,418,599 B2
(45) Date of Patent: Aug. 16, 2016

(54) DRIVING CIRCUIT OF LIQUID CRYSTAL DISPLAY DEVICE AND METHOD FOR DRIVING THE SAME

(75) Inventor: Jun Hyeok Yang, Gyeonggi-do (KR)

(73) Assignee: LG Display Co., Ltd., Seoul (KR)

( * ) Notice: Subject to any disclaimer, the term of this patent is extended or adjusted under 35 U.S.C. 154(b) by 1934 days.

(21) Appl. No.: 12/213,112

(22) Filed: Jun. 13, 2008

(65) Prior Publication Data

US 2008/0309611 A1 Dec. 18, 2008

(30) Foreign Application Priority Data

Jun. 15, 2007 (KR) ..... 10-2007-0058761

(51) Int. Cl.
*G09G 3/34* (2006.01)

(52) U.S. Cl.
CPC ..... *G09G 3/3426* (2013.01); *G09G 2320/0233* (2013.01); *G09G 2320/064* (2013.01); *G09G 2320/0666* (2013.01); *G09G 2360/145* (2013.01)

(58) Field of Classification Search
CPC ..... G09G 3/3406; G09G 2320/0626; G09G 2320/0233
USPC ..... 345/83, 102, 204
See application file for complete search history.

(56) References Cited

U.S. PATENT DOCUMENTS

| | | | | |
|---|---|---|---|---|
| 6,608,614 | B1 * | 8/2003 | Johnson | 345/102 |
| 2005/0058450 | A1 * | 3/2005 | Yamamoto et al. | 398/25 |
| 2006/0049781 | A1 * | 3/2006 | Lee et al. | 315/312 |
| 2006/0227085 | A1 * | 10/2006 | Boldt et al. | 345/83 |
| 2006/0284802 | A1 * | 12/2006 | Kohno | 345/76 |

FOREIGN PATENT DOCUMENTS

CN 1399158 A 2/2003

* cited by examiner

*Primary Examiner* — Kathy Wang-Hurst
*Assistant Examiner* — Jose Soto Lopez
(74) *Attorney, Agent, or Firm* — Morgan, Lewis & Bockius LLP

(57) ABSTRACT

A driving circuit of a liquid crystal display device and a method for driving the same, which are capable of reducing manufacturing cost of the liquid crystal display device and reducing a luminance deviation so as to improve image quality, are disclosed. The driving circuit of the liquid crystal display device includes an LED backlight which includes a plurality of LED modules arranged in a plurality of division areas and generates light, an internal photosensor which is mounted in any one of the plurality of division areas, for detecting a luminance value, a controller which generates and outputs a plurality of control signals for changing respective luminance values of the plurality of division areas according to the luminance value detected by the internal photosensor, and a plurality of LED drivers which drive the plurality of LED modules according to the plurality of control signals.

6 Claims, 6 Drawing Sheets

DRIVING CIRCUIT OF LIQUID CRYSTAL DISPLAY DEVICE AND METHOD FOR DRIVING THE SAME

This application claims the benefit of Korean Patent Application No. 10-2007-058761, filed on Jun. 15, 2007 which is hereby incorporated by reference as if fully set forth herein.

BACKGROUND OF THE INVENTION

1. Field of the Invention

The present invention relates to a liquid crystal display device, and more particularly, to a driving circuit of a liquid crystal display device and a method for driving the same, which are capable of reducing manufacturing cost of the liquid crystal display device and reducing a luminance deviation so as to improve image quality.

2. Discussion of the Related Art

A general liquid crystal display device displays an image by adjusting light transmission of liquid crystal having dielectric anisotropy using an electric field. The liquid crystal display device includes a liquid crystal panel in which pixel areas are arranged in a matrix, a driving circuit for driving the liquid crystal panel, and a backlight unit for irradiating light so as to display an image on the liquid crystal panel.

The backlight unit is classified into an edge backlight unit and a direct backlight unit according to the position of a fluorescent lamp. Here, the direct backlight unit is mainly used in a medium-sized or large-sized liquid crystal display device, such as a television receiver, and generates light using a plurality of LEDs or fluorescent lamps. In the LED backlight unit, an emission area is divided into a plurality of division areas and luminance values of the division areas can be controlled.

However, in a conventional liquid crystal display device, manufacturing cost is increased due to respective photosensors mounted in the division areas and a luminance deviation between the division areas is generated so as to deteriorate image quality. In other words, in the conventional liquid crystal display device, the photosensors should be respectively included in the division areas. The luminance of a specific area deteriorates by a temperature deviation between the division areas, a driving voltage deviation and an emission time deviation between the LEDs, thereby generating display unevenness.

SUMMARY OF THE INVENTION

Accordingly, the present invention is directed to a driving circuit of a liquid crystal display device and a method for driving the same that substantially obviate one or more problems due to limitations and disadvantages of the related art.

An object of the present invention is to provide a driving circuit of a liquid crystal display device and a method for driving the same, which are capable of reducing manufacturing cost of the liquid crystal display device and reducing a luminance deviation so as to improve image quality.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a driving circuit of a liquid crystal display device, the driving circuit including: an LED backlight which includes a plurality of LED modules arranged in a plurality of division areas and generates light; an internal photosensor which is mounted in any one of the plurality of division areas, for detecting a luminance value; a controller which generates and outputs a plurality of control signals for changing respective luminance values of the plurality of division areas according to the luminance value detected by the internal photosensor; and a plurality of LED drivers which drive the plurality of LED modules according to the plurality of control signals.

In another aspect of the present invention, there is a method for driving a liquid crystal display device including an LED backlight which includes a plurality of LED modules arranged in a plurality of division areas and generates light, the method comprising: detecting a luminance value of any one of the plurality of division areas; generating a plurality of control signals for controlling the plurality of division areas such that the detected luminance value of any one division area and luminance values of the other division areas become equal; and driving the plurality of division areas according to the plurality of control signals.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

Hereinafter, a driving circuit of a liquid crystal display device and a method for driving the same according to embodiments of the present invention will be described with reference to the accompanying drawings.

Figure 1:
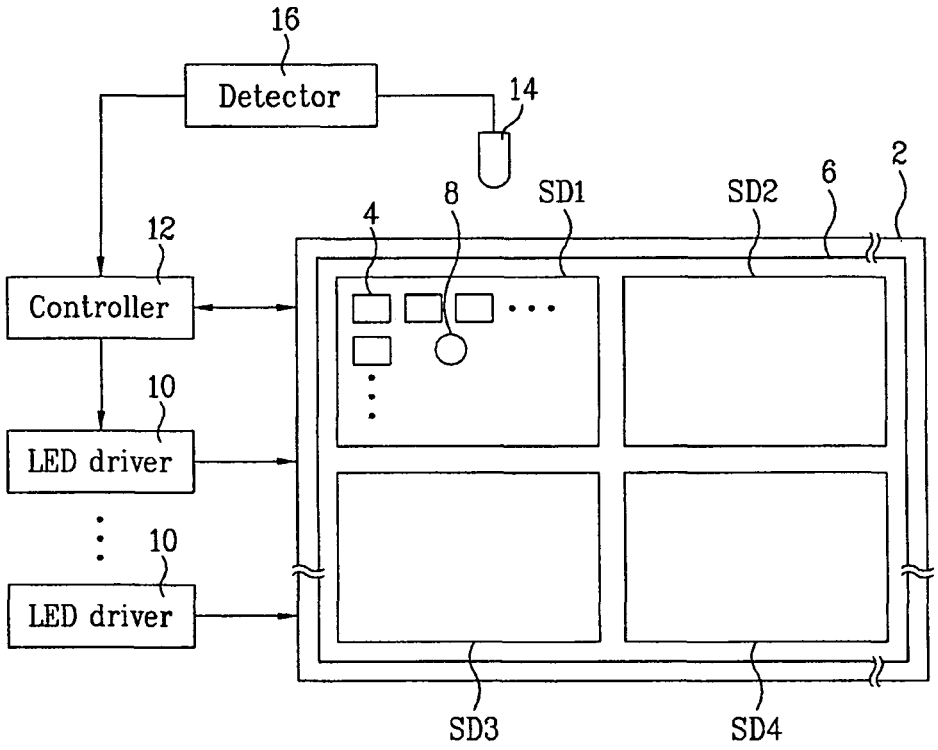
FIG. 1 is a block diagram showing the configuration of a liquid crystal display device according to an embodiment of the present invention.

FIG. 1 is a block diagram showing the configuration of a liquid crystal display device according to an embodiment of the present invention.

The liquid crystal display device shown in FIG. 1 includes a liquid crystal panel 2 in which a plurality of pixel areas are included, a LED backlight 6 which includes a plurality of LED modules 4 arranged in a plurality of division areas SD1 to SD4 and irradiates light onto the liquid crystal panel 2, an internal photosensor 8 for detecting a luminance value of any one of the plurality of division areas SD1 to SD4, a controller 12 for setting and outputting a plurality of control signals for controlling the luminance values of the division areas according to the luminance value detected by the internal photosensor 8, and a plurality of LED drivers for driving the plurality of LED modules 4 according to the plurality of control signals output from the controller 12.

The liquid crystal display device according to the embodiment of the present invention further includes a detector 16 for detecting the luminance values of the plurality of division areas SD1 to SD4 through an external photosensor 14 and supplying the detected luminance values to the controller 12. The detector 16 including the external photosensor 14 is mounted outside the liquid crystal display device so as to be connected to the controller 12 and may be detached from the controller 12 when the detection of the luminance values of the division areas SD1 to SD4 is completed.

In other words, in the liquid crystal display device shown in FIG. 1, the luminance values of the division areas SD1 to SD4 are detected and the plurality of control signals for driving the LED modules 4 are set according to the detected luminance values. Accordingly, in a state in which the liquid crystal panel 2 is not mounted on the LED backlight 6, the luminance values of the division areas SD1 to SD4 may be detected and the control signals for driving the LED modules 4 may be set according to the detected luminance values. The control signals may be pulse width modulation (PWM) signals or DC driving signals and may be set so as to be output in a state in which the pulse widths or amplitudes thereof are changed.

The liquid crystal panel 2 includes thin film transistors (TFTs) formed in the pixel areas defined by a plurality of gate lines and data lines (not shown) and liquid crystal capacitors connected to the TFTs. Each liquid crystal capacitor includes a pixel electrode connected to each TFT and a common electrode which faces the pixel electrode with liquid crystal interposed there between. Each TFT supplies a data signal from each data line to each pixel electrode in response to a scan pulse from each gate line. A difference voltage between the data signal supplied to the pixel electrode and a common voltage supplied to the common voltage is charged in each liquid crystal capacitor and the arrangement of liquid crystal molecules is changed according to the difference voltage so as to adjust light transmission, thereby achieving gradation display. A storage capacitor is connected to the liquid crystal capacitor in parallel such that the voltage charged in the liquid crystal capacitor is held until a next data signal is supplied. The storage capacitor is formed by overlapping the pixel electrode and a previous gate line with each other with an insulating film interposed therebetween. The storage capacitor may be formed by overlapping the pixel electrode and a storage line with each other with an insulating film interposed therebetween.

The LED backlight 6 is divided into m×n division areas SD1 to SDnm, that is, m×n emission areas SD1 to SD4, and m×n LED modules 4 are included in the emission areas SD1 to SDnm. However, in the embodiment of the present invention, for convenience of description, the case where the LED backlight 6 is divided into first to fourth division areas SD1 to SD4, that is, first to fourth emission areas SD1 to SD4, will be described.

The internal photosensor 8 is included in any one of the plurality of emission areas SD1 to SD4. The internal photosensor 8 detects the luminance value of any one emission area and supplies the detected luminance value to the controller 12. For example, the internal photosensor 8 may be interposed among the plurality of LED modules 4 included in the first emission area SD1. In more detail, if the internal photosensor 8 is formed in the central portion of the first emission area SD1, the internal photosensor 8 can detect the luminance value of the first emission area SD1 and supply the detected luminance value to the controller 12.

The controller 12 generates the plurality of control signals for driving the plurality of LED modules 4 such that the luminance value of any one emission area supplied from the internal photosensor 8 and the luminance values of the plurality of emission areas supplied from the detector 16 become equal. In other words, the controller 12 compares the luminance value of the first emission area SD1 supplied from the internal photosensor 8 with the luminance values of the second to fourth emission areas SD2 to SD4 supplied from the external photosensors 14. Then, the controller generates the plurality of control signals for driving the LED modules 4 of the second to fourth emission areas SD2 to SD4 and supplies the plurality of control signals to the plurality of LED drivers 10 such that the luminance value of the first emission area SD1 and the luminance value of the second to fourth emission areas SD2 to SD4 become equal to each other. Now, a method for generating the control signals according to the detected luminance values will be described in detail with reference to the accompanying drawings.

The plurality of LED drivers 10 supply driving currents to the plurality of LED modules 4 and drive the plurality of LED modules 4, according to the control signals received from the controller 12. In other words, the LED drivers 10 adjust the supply times or intensities of the driving currents supplied to the LED modules 4 and output the driving currents, according to the received control signals. At least one LED module 4 is connected to each LED driver 4 and the number of LED modules 4 connected to each LED driver 10 is determined in consideration of voltage drops in the vicinities of the LED modules 4. Although not shown, an LED block, in which a plurality of LEDs are connected in series, an inverter and a switching circuit may be included in each LED module 4.

The detector 16 sequentially detects the luminance values of the plurality of division areas in which the internal photosensor 8 is not included, that is, the second to fourth emission areas SD2 to SD4, using the external photosensor 14. The detector 16 supplies the luminance values of the emission areas SD2 to SD4 to the controller 12 in real time. The detector 16 is mounted outside the liquid crystal display device and is electrically connected to the controller 12. The external photosensor 14 is electrically connected to the detector 16 and may be movably mounted, for detecting the luminance values of the emission areas SD2 to SD4 in which the internal photosensor 8 is not included. If the detection of the luminance values of the emission areas SD1 to SD4 is completed, the detector 16 may be detached from the controller 12 and the external photosensor 14 may be detached from the detector 16.

Figure 2A:
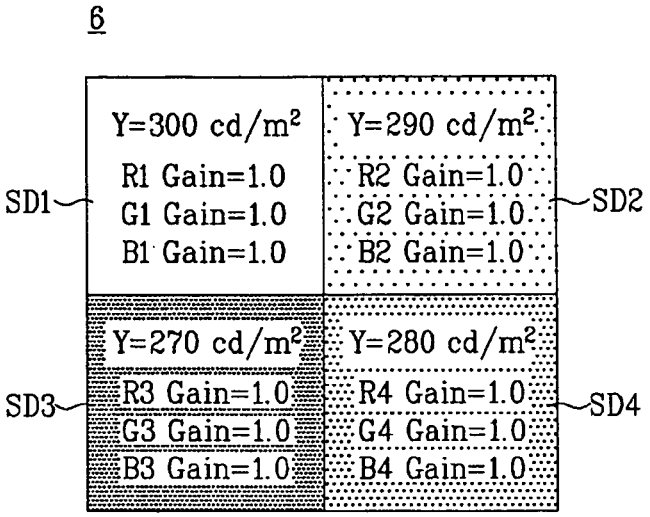
FIGS. 2A and 2B are views explaining a method for adjusting luminance values of emission areas of a backlight.
Figure 2B:
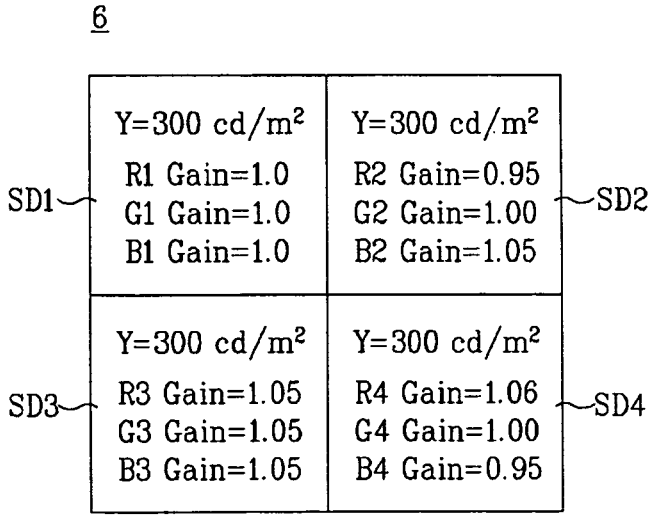
Figure 3:
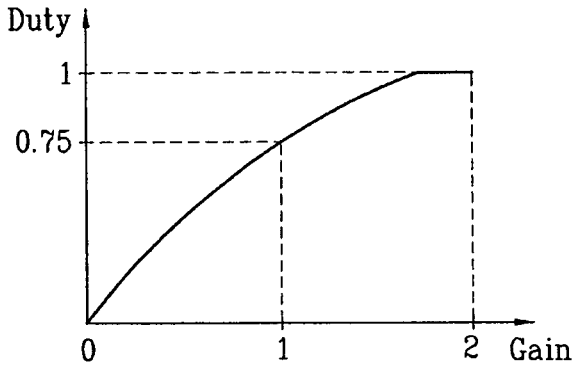
FIG. 3 is a graph showing a relationship between a duty ratio and a gain value.

FIGS. 2A and 2B are views explaining a method for adjusting the luminance values of the emission areas of the backlight. FIG. 3 is a graph showing a relationship between a duty ratio and a gain value.

Referring to FIGS. 1 to 2B, among the emission areas SD1 to SD4 of the backlight 6, the luminance value of the first emission area SD1 is detected by the internal photosensor 8 in real time and the luminance values of the other emission areas SD2 to SD4 are sequentially measured using the external photosensor 14. Then, the luminance values of the other emission areas SD2 to SD4 are sequentially adjusted on the basis of the luminance value of the first emission area SD1 such that the luminance values of all the emission areas SD1 to SD4 become equal.

If the luminance values of the emission areas SD1 to SD4 are sequentially measured after light are emitted from all the first to fourth emission areas SD1 to SD4, the luminance values of the emission areas SD1 to SD4 may be different from one another. In more detail, the luminance values of the emission areas SD1 to SD4 vary according to a temperature deviation between the emission areas SD1 to SD4, a driving current deviation and an emission time deviation between the LEDs. For example, if the luminance value of the first emission area SD1 is measured by the internal photosensor 8 and the luminance values of the other emission areas SD2 to SD4 are sequentially measured by the external photosensor 14, the luminance values Y of the emission areas SD1 to SD4 may be measured as shown in FIG. 2A.

Referring to FIGS. 2A and 3, if the light is emitted in a state in which the gain values Gain of the emission areas SD1 to SD4 are fixed to 1.0, the R, G and B LED modules 4 of the emission areas SD1 to SD4 may be driven with a duty ratio of about 0.75. In this case, the luminance value Y of the first emission area SD1 is 300 cd/m$^2$, the luminance value Y of the second emission area SD2 is 290 cd/m$^2$, the luminance value Y of the third emission area SD3 is 270 cd/m$^2$, and the luminance value Y of the fourth emission area SD4 is 280 cd/m$^2$.

At this time, as shown in FIG. 2B, the gain values Gain of the second to fourth emission areas SD2 to SD4 are sequentially and repeatedly adjusted on the basis of the luminance value Y and the gain value Gain of the first emission area SD1 such that the luminance values Y of the second to fourth emission areas SD2 to SD4 become equal to the luminance value Y of the first emission area SD1. For example, if the luminance value Y of the first emission area SD1 detected by the internal photosensor 8 is 300 cd/m$^2$ and the gain value Gain for driving the R, G and B LED modules 4 of the first emission area SD1 is 1.0, the luminance value Y of the second emission area SD2 is first adjusted on the basis of the luminance value Y of 300 cd/m$^2$. That is, if the luminance value Y detected by the external photosensor 14 is 290 cd/m$^2$, the gain values Gain for driving the R, G and B LED modules 4 of the second emission area SD2 are respectively adjusted to 0.95, 1.0 and 1.5 such that the luminance value Y of the second emission area SD2 is adjusted to 300 cd/m$^2$. If the luminance value Y of the second emission area SD2 is changed, the luminance value Y of the first emission area SD1 may be changed. Even in this case, the gain value Gain of the second emission area SD2 is repeatedly adjusted on the basis of the luminance value Y and the gain value Gain of the first emission area SD1 such that the luminance value Y of the second emission area SD2 becomes equal to the luminance value Y of the first emission area SD1.

Next, if the luminance value Y of the third emission area SD3 detected by the external photosensor 14 is 270 cd/m$^2$, the gain values Gain for driving the R, G and B LED modules 4 of the third emission area SD3 are respectively adjusted to 1.05, 1.05, and 1.05 such that the luminance value Y of the third emission area SD3 is adjusted to 300 cd/m$^2$.

Subsequently, if the luminance value Y of the fourth emission area SD4 detected by the external photosensor 14 is 280 cd/m$^2$, the gain values for driving the R, G and B LED modules 4 of the fourth emission area SD4 are respectively adjusted to 1.06, 1.00, and 0.95 such that the luminance value Y of the fourth emission area SD4 is adjusted to 300 cd/m$^2$.

Here, among the emission areas SD1 to SD4, when the light is emitted from only the first emission area SD1 and the other emission areas SD2 to SD4 are turned off, the luminance value of the first emission area SD1 may be measured by the internal photosensor 8. When the luminance values of the other emission areas SD2 to SD4 are measured by the external photosensor 14 while the light is sequentially emitted from the other emission areas SD2 to SD4, the luminance values of the emission areas SD2 to SD4 are adjusted to become equal to the luminance value of the first emission area SD1. Even when the luminance values are measured as described above, the gain values Gain are adjusted such that the luminance values of the other emission areas SD2 to SD4 become equal to the luminance value of the first emission area SD1, thereby setting the plurality of control signals.

Figure 4A:
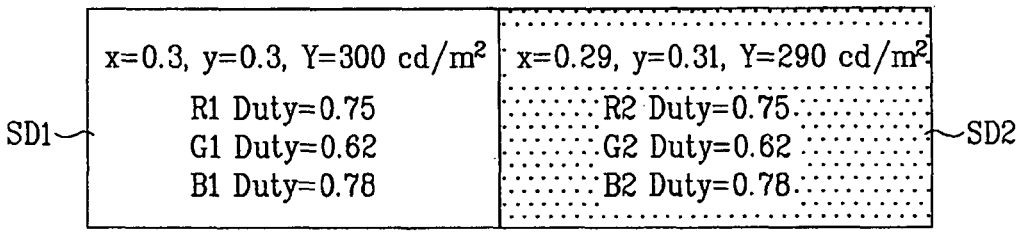
FIGS. 4A to 4C are views explaining another method for adjusting the luminance values of the emission areas.
Figure 4B:
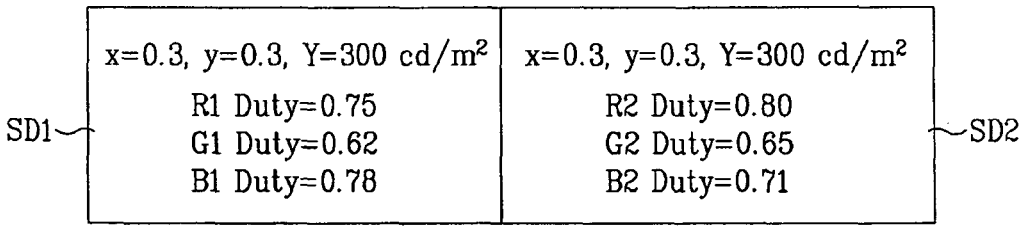
Figure 4C:
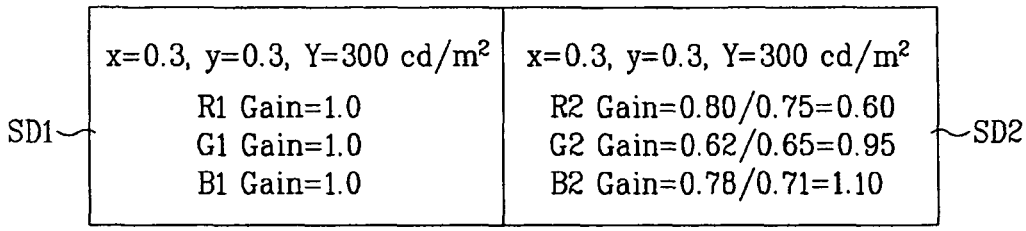

FIGS. 4A to 4C are views explaining another method for adjusting the luminance values of the emission areas.

Referring to FIGS. 3 to 4C, the luminance value of the first emission area SD1 is detected by the internal photosensor 8 in real time and the duty ratios Duty of the other emission areas SD2 to SD4 are sequentially adjusted on the basis of the luminance value and the duty ratio Duty of the first emission area SD1 such that the luminance values of all the emission areas SD1 to SD4 are equal. The gain values Gain of the other emission areas SD2 to SD4 may be set on the basis of the luminance value and the duty ratio of the first emission area SD1.

For example, as shown in FIG. 4A, the luminance value Y of the first emission area SD1 is 300 cd/m$^2$ and the X-axis coordinate value and the Y-axis coordinate value of a color which is displayed at this time are respectively 0.3 and 0.3, the duty ratios of the R1, G1 and B1 LED modules 4 are respectively 0.75, 0.62 and 0.78. The R2, G2 and B2 LED modules 4 of the second emission area SD2 are driven with the same duty ratio as the R1, G1 and B1 LED modules 4 of the first emission area SD1. However, the luminance value Y of the second emission area SD2 detected by the external photosensor 14 is 290 cd/m$^2$ and the X-axis coordinate value and the Y-axis coordinate value of the color which is displayed at this time are respectively 0.29 and 0.31.

In this case, as shown in FIG. 4B, the duty ratios Duty of the R2, G2 and B2 LED modules 4 of the second emission area SD2 are adjusted on the basis of the duty ratios Duty of the R1, G1 and B1 LED modules 4 and the luminance value Y of the first emission area SD1. In other words, the duty ratios of the R2, G2 and B2 LED modules 4 are respectively adjusted to 0.75, 0.62 and 0.78 such that the luminance value Y and the color coordinates of the second emission area SD2 are equal to the luminance value Y and the color coordinates of the first emission area SD1.

As shown in FIG. 4C, the gain value Gain of the second emission area SD2 may be set on the basis of the duty ratio Duty of the first emission area SD1. In more detail, the gain values Gain of R1, G1 and B1 corresponding to the duty ratios of the R1, G1 and B1 LED modules 4 are set to 1.0. The gain values Gain of R2, G2 and B2 are respectively set to 0.6, 0.95 and 1.1 by respectively dividing the duty ratios Duty of the R1, G1 and B1 LED modules 4 by the duty ratios Duty of the R2, G2 and B2 LED modules 4. Thereafter, the same method as FIGS. 4A to 4C is performed with respect to the emission areas SD3 and SD4 so as to set the gain values gain.

The controller 12 according to the embodiment of the present invention sets the control signals, in which the gain values and the duty ratios are changed, such that the luminance value of the first emission area SD1 and the other emission areas SD2 to SD4 become equal, and supplies the control signals to the LED drivers 10 such that all the luminance values of the emission areas SD1 to SD4 become equal.

Figure 5:
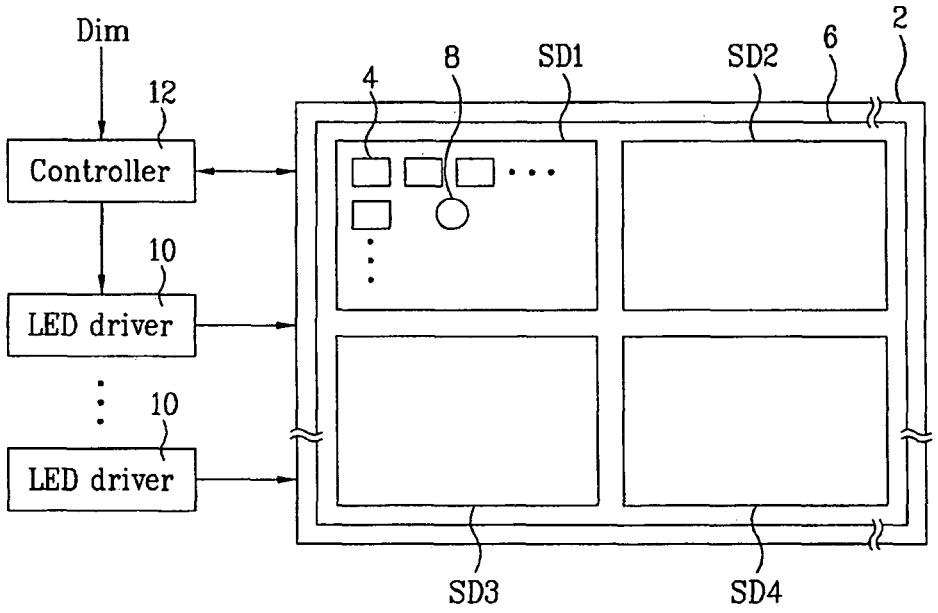
FIG. 5 is a view showing the configuration of a liquid crystal display device according to another embodiment of the present invention.

FIG. 5 is a view showing the configuration of a liquid crystal display device according to another embodiment of the present invention.

In the liquid crystal display device shown in FIG. 5, the external photosensor 14 and the detector 16 are detached. The duty ratios Duty of the control signals for driving the emission areas SD1 to SD4 are changed according to the predetermined gain values Gain and an externally input dimming signal Dim. The plurality of LED modules 4 are driven according to the control signals, in which the duty ratios are changed, so as to reduce a luminance deviation between the emission areas SD1 to SD4.

In more detail, when the external photosensor 14 and the detector 16 are detached from the liquid crystal display device, the controller 12 changes the duty ratios of the control signals for driving the emission areas SD1 to SD4 according to the predetermined gain values Gain and the externally input dimming signal Dim and supplies the control signals to the LED drivers 10.

Figure 6:
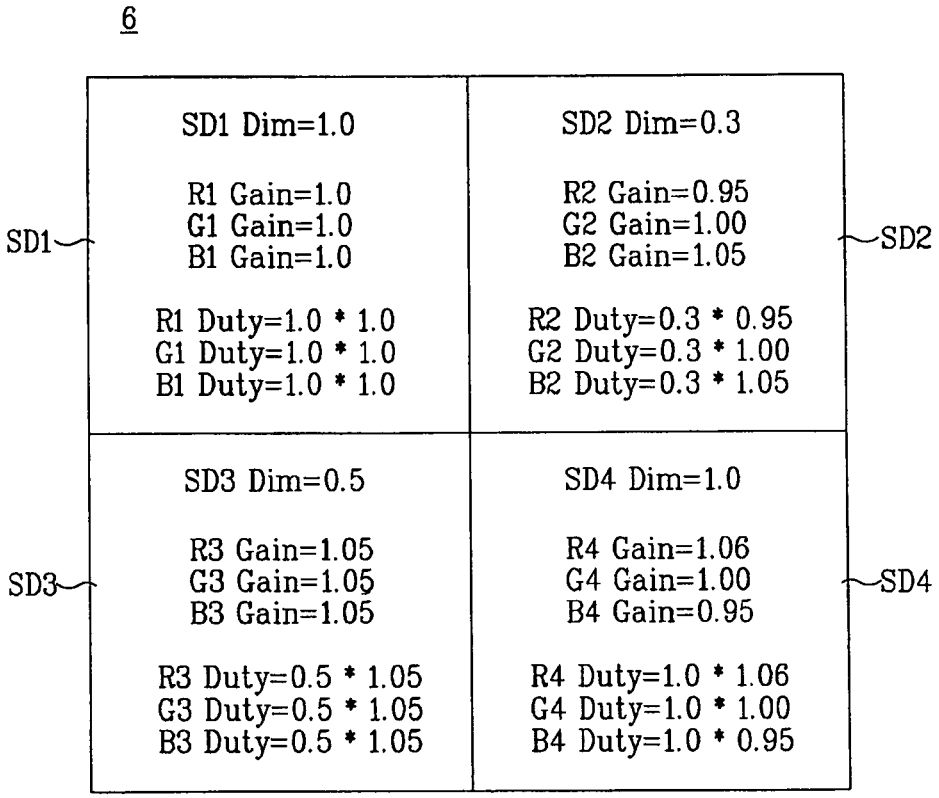
FIG. 6 is a view explaining a method for adjusting luminance values of emission areas according to another embodiment of the present invention.

FIG. 6 is a view explaining a method for adjusting the luminance values of the emission areas according to another embodiment of the present invention.

The method for adjusting the luminance of the emission areas SD1 to SD4 according to another embodiment of the present invention will be described in detail with reference to FIGS. 5 and 6.

Referring to FIG. 6, the duty ratios Duty of the control signals supplied to the LED drivers 10 in order to drive the R, G and B LED modules 4 of the first division area SD1 are changed according to the gain values Gain, which are set in order to drive the first division area SD1, and the externally input dimming signal Dim. In more detail, the duty ratios Duty of the control signals are changed according to the gain values Gain, which are set in order to drive the first division area SD1, and the duty ratio Duty of the externally input dimming signal Dim and the control signals are supplied to the LED drivers 100 so as to control the R, G and B LED modules 4.

For example, the gain values Gain for driving the first division area SD1 may be set to 1.0 and, at this time, the duty ratio of the externally input dimming signal Dim may be set to 1.0. Then, the controller 12 outputs the control signals having a value of 1.0, which is obtained by multiplying the gain values Gain of 1.0 of the R1, G1 and B1 LED modules 4 by the duty ratio of 1.0 of the dimming signal Dim, as the duty ratios. At this time, the control signals which are supplied to the LED drivers 10 in a state in which the duty ratios thereof are changed may be output by changing the duty ratio of the externally input dimming signal Dim.

Next, the duty ratios Duty of the control signals for driving the R2, G2 and B2 LED modules 4 of the second division area SD2 are changed according to the gain values Gain, which are set in order to drive the second division area SD2, and the externally input dimming signal Dim. In more detail, the duty ratios of the control signals are changed according to the gain values, which are set in order to drive the second division area SD2, and the duty ratio of the externally input dimming signal Dim, the control signals are supplied to the LED drivers 10 for driving the second division area SD2 so as to control the R2, G2 and B2 LED modules 4.

For example, the gain values Gain of R, G and B for driving the second division area SD2 may be respectively set to 0.95, 1.0 and 1.05 and, at this time, the duty ratio Duty of the externally input dimming signal Dim may be set to 0.3. Then, the controller 12 outputs the control signals having the values, which are obtained by multiplying the gain values of R, G and B by the duty ratio of 0.3 of the dimming signal Dim, as the duty ratios. The control signals which are supplied to the LED drivers 10 in a state in which the duty ratios thereof are changed are changed may be output by changing the duty ratio of the externally input dimming signal Dim. In other words, the dimming signal Dim having the duty ratio of 0.3 may be changed to the control signals having the duty ratios of 0.29, 0.3 and 0.32, which are supplied to the LED drivers 10.

The duty ratios Duty of the control signals for driving the R3, G3 and B3 LED modules 4 of the third division area SD3 are changed according to the gain values Gain, which are set in order to drive the third division area SD3, and the externally input dimming signal Dim. For example, the gain values of R, G and B for driving the third division area SD3 may be set to 1.05 and, at this time, the duty ratio Duty of the externally input dimming signal Dim may be set to 0.5. Then, the controller 12 outputs the control signals having the value of 0.53, which are obtained by multiplying the gain values Gain of R, G and B of 1.05 by the duty ratio Duty of 0.5 of the dimming signal Dim, as the duty ratios. The control signals which are supplied to the LED drivers 10 in a state in which the duty ratios thereof are changed may be output by changing the duty ratio of the externally input dimming signal Dim. In other words, the dimming signal Dim having the duty ratio of 0.5 may be changed to the control signals having the duty ratio of 0.53, which are supplied to the LED drivers 10.

Next, the duty ratios Duty of the control signals for driving the R4, G4 and B4 LED modules 4 of the fourth division area SD4 are changed according to the gain values Gain, which are set in order to drive the fourth division area SD4, and the externally input dimming signal Dim. For example, the gain values Gain of R, G and B for driving the fourth division area SD4 may be respectively set to 1.06, 1.0 and 0.95 and, at this time, the duty ratio Duty of the externally input dimming signal Dim may be set to 1.0. Then, the controller 12 outputs the control signals having the values of 1.06, 1.0 and 0.95, which are obtained by multiplying the gain values Gain of R, G and B of 1.06, 1.0 and 0.95 by the duty ratio of 1.0 of the dimming signal Dim, as the duty ratios. The control signals which are supplied to the LED drivers 10 in a state in which the duty ratios thereof are changed may be output by changing the duty ratio of the externally input dimming signal Dim.

As described above, in the liquid crystal display device according to the embodiment of the present invention, it is possible to minimize a luminance deviation between the emission areas SD1 to SD4 using one internal photosensor 8, which is mounted in any one of the plurality of emission areas SD1 to SD4, and the detachable external photosensor 14 and the detachable detector 16. That is, it is possible to reduce the manufacturing cost of the liquid crystal display device by mounting at least one internal photosensor 8 in the liquid crystal display device. In addition, it is possible to improve image quality by minimizing the luminance deviation between the emission areas SD1 to SD4.

As described above, the driving circuit of the liquid crystal display device and the method for driving the same according to the embodiment of the present invention have the following effects.

First, it is possible to reduce the manufacturing cost of the liquid crystal display device by using at least one internal photosensor which is mounted in any one of a plurality of emission areas, that is, a plurality of division areas.

Second, it is possible to prevent display unevenness and improve image quality by minimizing a luminance deviation between the emission areas.

It will be apparent to those skilled in the art that various modifications and variations can be made in the present invention without departing from the spirit or scope of the invention. Thus, it is intended that the present invention covers the modifications and variations of this invention provided they come within the scope of the appended claims and their equivalents.

What is claimed is:

1. A driving circuit of a liquid crystal display device, the driving circuit comprising:

an LED backlight which includes a plurality of LED modules arranged in a plurality of division areas and generates light;

an internal photosensor which is mounted in any one of the plurality of division areas, for detecting a luminance value;

a detector which detects the luminance values of the division areas, in which the internal photosensor is not included, through an external photosensor and supplies the luminance values to a controller, wherein the controller generates and outputs a plurality of control signals for changing respective luminance values of the plurality of division areas according to the luminance value detected by the internal photosensor; and a plurality of LED drivers which drive the plurality of LED modules according to the plurality of control signals, wherein the controller compares the luminance value of the first division area supplied from the internal photosensor with the luminance values of the second to fourth division areas supplied from the external photosensor, and generates the plurality of control signals according the compare result, wherein the controller sets the control signals, in which the gain values or the duty ratios are changed, such that the luminance value of the first division area and the other division areas become equal, and supplies the control signals to the LED drivers such that all the luminance values of the division areas become equal, wherein the controller sets the control signals, in which the duty ratios or gain values of the second to fourth division areas are sequentially adjusted on the basis of the duty ratio of the first emission area and the luminance value of the first emission area detected by the internal photosensor in real time, wherein the plurality of LED drivers adjust the supply times or intensities of the driving currents supplied to the LED modules and output the driving currents, according to the received control signals.

2. The driving circuit according to claim 1, wherein the controller sequentially and repeatedly adjusts gain values or duty ratios of the division areas such that the luminance value of the internal photosensor and the luminance values received from the detector become equal, sets the plurality of control signals so as to correspond to the adjusted gain values or duty ratios, and supplies the plurality of control signals to the plurality of LED drivers.

3. The driving circuit according to claim 2, wherein the controller generates the control signals so as to correspond to result values, result values are obtained by multiplying the adjusted gain values of the division areas by a duty ratio of an externally input dimming signal, and supplies the control signals to the LED drivers.

4. A method for driving a liquid crystal display device including an LED backlight which includes a plurality of LED modules arranged in a plurality of division areas and generates light, the method comprises:

detecting a luminance value of any one of the plurality of division areas;

sequentially and repeatedly detecting the luminance values of the other division areas excluding any one division area of which the luminance value is detected;

generating a plurality of control signals for controlling the plurality of division areas such that the detected luminance value of any one division area and luminance values of the other division areas become equal; and driving the plurality of division areas according to the plurality of control signals, wherein the generating of the plurality of control signals comprises compares the luminance value of the first division area supplied from an internal photosensor with the luminance values of the second to fourth division areas supplied from a external photosensor, wherein the generating of the plurality of control signals comprises sets the control signals, in which the gain values or the duty ratios are changed, such that the luminance value of the first division area and the other division areas become equal, and supplies the control signals to the LED drivers such that all the luminance values of the division areas become equal, wherein the generating of the plurality of control signals comprises sets the control signals, in which the duty ratios or gain values of the second to fourth division areas are sequentially adjusted on the basis of the duty ratio of the first emission area and the luminance value of the first emission area detected by the internal photosensor in real time, wherein the driving the plurality of division areas comprises adjust the supply times or intensities of the driving currents supplied to the LED modules and output the driving currents, according to the received control signals.

5. The method according to claim 4, wherein the generating of the plurality of control signals comprises sequentially and repeatedly adjusting gain values or duty ratios of the other division areas such that the luminance value of any one division area and the luminance values of the other division areas become equal, and setting the plurality of control signals so as to correspond to the adjusted gain values or duty ratios.

6. The method according to claim 4, wherein the generating of the plurality of control signals comprises setting the control signals so as to correspond to result values, result values are obtained by multiplying the adjusted gain values of the division areas by a duty ratio of an externally input dimming signal.

* * * * *